US010957958B2

(12) United States Patent
Kikuda et al.

(10) Patent No.: US 10,957,958 B2
(45) Date of Patent: Mar. 23, 2021

(54) DIELECTRIC RESONATOR AND DIELECTRIC FILTER

(71) Applicant: Murata Manufacturing Co., Ltd., Nagaokakyo (JP)

(72) Inventors: Masayuki Kikuda, Nagaokakyo (JP); Hitoshi Tada, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/223,359

(22) Filed: Dec. 18, 2018

(65) Prior Publication Data

US 2019/0148805 A1 May 16, 2019

Related U.S. Application Data

(63) Continuation of application No. PCT/JP2017/022785, filed on Jun. 21, 2017.

(30) Foreign Application Priority Data

Jun. 22, 2016 (JP) ..... JP2016-123106

(51) Int. Cl.
*H01P 1/20* (2006.01)
*H01P 7/10* (2006.01)
*H01P 1/205* (2006.01)

(52) U.S. Cl.
CPC ..... *H01P 1/2002* (2013.01); *H01P 1/2056* (2013.01); *H01P 7/10* (2013.01)

(58) Field of Classification Search
CPC ..... H01P 1/2002; H01P 1/2056; H01P 7/10
(Continued)

(56) References Cited

U.S. PATENT DOCUMENTS 6,002,307 A 12/1999 Arakawa
6,026,281 A * 2/2000 Yorita ..... H01P 1/2053 333/134

(Continued)

FOREIGN PATENT DOCUMENTS

CN 1330430 A 1/2002
CN 105280994 A 1/2016

(Continued)

OTHER PUBLICATIONS

Official Communication issued in Chinese Patent Application No. 201780035902.0, dated Aug. 19, 2019.

(Continued)

*Primary Examiner* — Rakesh B Patel
(74) *Attorney, Agent, or Firm* — Keating & Bennett, LLP

(57) ABSTRACT

A dielectric resonator includes a dielectric block, an external conductor, and wall-surface conductors. The dielectric block has a rectangular parallelepiped shape including a first surface and a second surface opposed to each other. The dielectric block includes a through hole extending from the first surface to the second surface. The external conductor is disposed on an outer surface of the dielectric block. The wall-surface conductors are disposed on a wall surface defining the through hole. The wall-surface conductor includes a first portion of the through hole adjacent to the first surface and a second portion of the through hole adjacent to the second surface. The first and second portions of the wall-surface conductors are separated by a separation distance.

7 Claims, 5 Drawing Sheets

(58) Field of Classification Search
USPC ..... 333/202, 208, 219.1
See application file for complete search history.

(56) References Cited

U.S. PATENT DOCUMENTS

| | | | | |
|---|---|---|---|---|
| 6,313,720 | B1 * | 11/2001 | Kitaichi | H01P 1/20336 333/204 |
| 2001/0000429 | A1 | 4/2001 | Arakawa et al. | |
| 2001/0052833 | A1 | 12/2001 | Enokihara et al. | |
| 2013/0293320 | A1 * | 11/2013 | Komatsu | C01G 25/006 333/202 |

FOREIGN PATENT DOCUMENTS

| | | | |
|---|---|---|---|
| CN | 205141103 | U | 4/2016 |
| JP | 10-93311 | A | 4/1998 |
| JP | 10-276010 | A | 10/1998 |
| JP | 11-239006 | A | 8/1999 |
| JP | 3852598 | B2 | 11/2006 |

OTHER PUBLICATIONS

Official Communication issued in International Patent Application No. PCT/JP2017/022785, dated Sep. 5, 2017.
Official Communication issued in corresponding Chinese Patent Application No. 201780035902.0, dated Oct. 16, 2020.

* cited by examiner

DIELECTRIC RESONATOR AND DIELECTRIC FILTER

CROSS REFERENCE TO RELATED APPLICATIONS

This application claims the benefit of priority to Japanese Patent Application No. 2016-123106 filed on Jun. 22, 2016 and is a Continuation Application of PCT Application No. PCT/JP2017/022785 filed on Jun. 21, 2017. The entire contents of each application are hereby incorporated herein by reference.

BACKGROUND OF THE INVENTION

1. Field of the Invention

The present invention relates to dielectric resonators using TE-mode resonance and to dielectric filters in which the dielectric resonators are coupled.

2. Description of the Related Art

Japanese Patent No. 3852598 describes a dielectric filter using TE-mode resonance. The dielectric filter described in Japanese Patent No. 3852598 includes a plurality of dielectric resonators.

Each of the dielectric resonators includes a dielectric block and an external conductor. The dielectric block has a rectangular parallelepiped shape. The external conductor is disposed on substantially the entire surfaces of the dielectric block. A resonant frequency of the dielectric resonator is set by a relative permittivity and outer dimensions of the dielectric block.

In order to achieve different resonant frequencies for a plurality of dielectric resonators, when their dielectric blocks are made of the same material (materials with the same relative permittivity), it is necessary to form them with different outer dimensions.

However, if the dielectric blocks in the plurality of dielectric resonators have mutually different outer dimensions, the outer dimensions of a dielectric filter, that is, the outer dimensions of a product varies depending on desired characteristics as the dielectric filter. In other words, because it is impossible to manufacture dielectric filters having different filter characteristics with the same outer dimensions, it is necessary to form dielectric blocks with different outer dimensions, and this process requires increased time and effort.

SUMMARY OF THE INVENTION

Preferred embodiments of the present invention provide dielectric resonators using TE-mode resonance and in which resonant frequencies are able to be adjusted without changing outer dimensions thereof.

A dielectric resonator according to a preferred embodiment of the present invention includes a dielectric block, an external conductor, and a wall-surface conductor. The dielectric block has a rectangular or substantially rectangular parallelepiped shape that includes a first surface and a second surface opposed to each other. The dielectric block includes a through hole that extends from the first surface to the second surface. The external conductor is disposed on an outer surface of the dielectric block. The wall-surface conductor is disposed on a wall surface defining the through hole. The wall-surface conductor includes a first portion including an end portion of the through hole adjacent to the first surface and a second portion including an end portion of the through hole adjacent to the second surface. The first portion and the second portion are electrically isolated from each other.

In this configuration, TE-mode resonance at a resonant frequency corresponding to the separation distance between the first portion and the second portion of the wall-surface conductor occurs in the dielectric block. Accordingly, the resonant frequency is adjusted by adjustment of that separation distance.

A dielectric filter according to a preferred embodiment of the present invention includes a plurality of dielectric resonators including the above-described dielectric resonator, in which the wall-surface conductor around the through hole includes a separation portion, and the plurality of dielectric resonators are coupled.

In this configuration, the inclusion of the above-described dielectric resonator allows the filter characteristics of the dielectric filter to be adjusted without changing the outer dimensions of the dielectric resonator portion using TE-mode resonance.

A dielectric filter according to a preferred embodiment of the present invention may preferably have a configuration as described below. The dielectric filter may include a first dielectric resonator and a second dielectric resonator. Each of the first dielectric resonator and the second dielectric resonator may have a configuration of the above-described dielectric resonator, in which the wall-surface conductor around the through hole includes a separation portion. A separation distance between the first portion and the second portion in the first dielectric resonator and a separation distance between the first portion and the second portion in the second dielectric resonator may be different from each other.

In this configuration, even with the same outer dimensions for the first dielectric resonator and the second dielectric resonator, they have different resonant frequencies. Thus, the dielectric filter in which the two dielectric resonators having the different resonant frequencies are coupled has a simplified shape and is able to be easily manufactured.

A dielectric filter according to a preferred embodiment of the present invention may have a configuration as described below. Each of the plurality of dielectric resonators may have the configuration of the above-described dielectric resonator, in which the wall-surface conductor around the through hole includes the separation portion. The plurality of dielectric resonators may have mutually different separation distances between their respective first portions and second portions.

In this configuration, even with the same outer dimensions for all of the dielectric resonators defining the dielectric filter, the dielectric resonators are able to have different resonant frequencies. Thus, the dielectric filter in which the plurality of dielectric resonators having different resonant frequencies are coupled has a simplified shape and is able to be easily manufactured.

According to preferred embodiments of the present invention, with use of TE-mode resonance, the resonant frequency is able to be adjusted without changing outer dimensions.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Dielectric resonators and dielectric filters according to preferred embodiments of the present invention will be described with reference to the accompanying drawings.

Figure 1A:
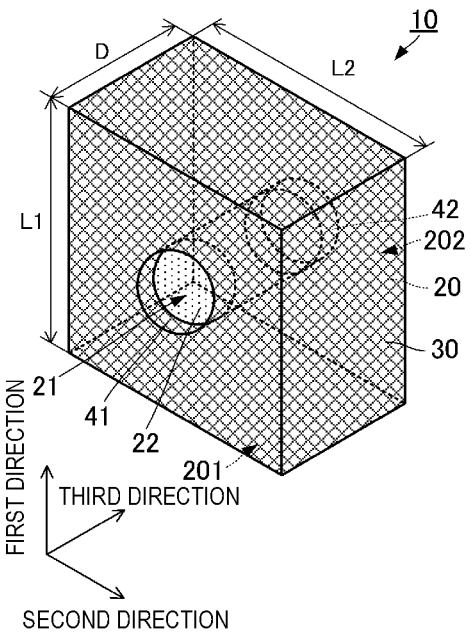
FIG. 1A is an external perspective view of a dielectric resonator according to a first preferred embodiment of the present invention.
Figure 1B:
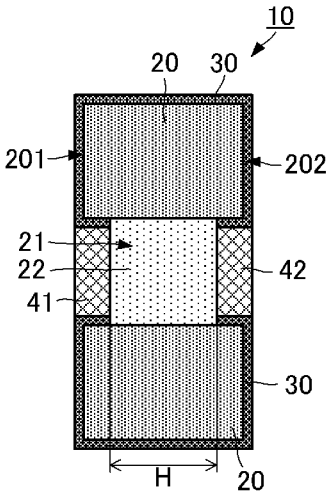
FIG. 1B is a cross-sectional view that illustrates a configuration of the dielectric resonator according to the first preferred embodiment of the present invention.

A dielectric resonator and a dielectric filter according to a first preferred embodiment of the present invention are described with reference to the drawings. FIG. 1A is an external perspective view of the dielectric resonator according to the first preferred embodiment of the present invention. FIG. 1B is a cross-sectional view that illustrates a configuration of the dielectric resonator according to the first preferred embodiment of the present invention. In the illustration of FIG. 1B, the thicknesses of an external conductor and wall-surface conductors are magnified.

As illustrated in FIGS. 1A and 1B, a dielectric resonator 10 includes a dielectric block 20, an external conductor 30, and wall-surface conductors 41 and 42.

The dielectric block 20 is preferably made of, for example, a dielectric ceramic material or other suitable dielectric material. The dielectric block 20 has a high relative permittivity, and one example of that relative permittivity may preferably be in a range of about 40 to about 50, for example.

The dielectric block 20 preferably has a rectangular or substantially rectangular parallelepiped shape and includes a first surface 201 and a second surface 202, which are opposed to each other. The outer dimensions of the dielectric block 20 are expressed as L1, L2, and D. L1 is the length in the first direction which defines one dimension of each of the first surface 201 and second surface 202. L2 is the length in the second direction which defines another dimension of each of the first surface 201 and second surface 202 and is the length in a direction perpendicular or substantially perpendicular to the first direction. D is the length in the third direction which defines the distance between the first surface 201 and second surface 202 and is the length in a direction perpendicular or substantially perpendicular to the first direction and second direction. The length L1 in the first direction and the length L2 in the second direction are preferably the same. Here, the meaning of the lengths being the same includes the lengths being substantially the same within manufacturing tolerances. The length D in the third direction is preferably shorter than each of the length L1 in the first direction and the length L2 in the second direction.

The dielectric block 20 includes a through hole 21. The through hole 21 extends through the dielectric block 20 from the first surface 201 to the second surface 202. The through hole 21 is preferably circular or substantially circular, for example, as viewed in a direction perpendicular or substantially perpendicular to the first surface 201 and second surface 202. The axis in the extending direction of the through hole 21 is perpendicular or substantially perpendicular to the first surface 201 and second surface 202 (is parallel or substantially parallel to the third direction).

The external conductor 30 is disposed on the entire or substantially the entire outer surface of the dielectric block 20. The outer surface of the dielectric block 20 includes the first surface 201, second surface 202, and four surfaces connecting the first surface 201 and second surface 202. The external conductor 30 is preferably made of a material having high conductivity, for example, a metal, such as silver (Ag).

The wall-surface conductor 41 is disposed on an end portion of a wall surface 22 defining the through hole 21 adjacent to the first surface 201. The wall-surface conductor 41 is connected to the external conductor 30 at the end portion of the through hole 21 adjacent to the first surface 201. The wall-surface conductor 41 extends around the entire or substantially the entire perimeter of the wall surface 22 defining the through hole 21. The wall-surface conductor 41 extends from the end portion of the through hole 21 adjacent to the first surface 201 along the axial direction of the through hole 21 and has a predetermined length. The wall-surface conductor 41 corresponds to "first portion" of the wall-surface conductor. The wall-surface conductor 41 is preferably made of a material having high conductivity, for example, a metal, such as silver (Ag), and that material may preferably be the same as that of the external conductor 30.

The wall-surface conductor 42 is disposed on an end portion of the wall surface 22 defining the through hole 21 adjacent to the second surface 202. The wall-surface conductor 42 is connected to the external conductor 30 at the end portion of the through hole 21 adjacent to the second surface 202. The wall-surface conductor 42 extends around the entire or substantially the entire perimeter of the wall surface 22 defining the through hole 21. The wall-surface conductor 42 extends from the end portion of the through hole 21 adjacent to the second surface 202 along the axial direction of the through hole 21 and has a predetermined length. The wall-surface conductor 42 corresponds to "second portion" of the wall-surface conductor. The wall-surface conductor 42 is preferably made of a material having high conductivity, for example, a metal, such as silver (Ag), and that material may preferably be the same as that of the external conductor 30.

The wall-surface conductors 41 and 42 are electrically isolated from each other along the axial direction of the through hole 21 on the wall surface 22 defining the through hole 21. That is, no conductor is provided between the wall-surface conductors 41 and 42. The separation distance between the wall-surface conductors 41 and 42 corresponds to a "separation distance".

The dielectric resonator 10 having the above-described configuration produces TE-mode resonance. A resonant frequency f0 for TE-mode resonance is set by the outer dimensions (L1, L2, D) of the dielectric block 20, the diameter ϕ of the through hole 21, the relative permittivity $\varepsilon_r$ of the dielectric block 20, and the shapes of the wall-surface conductors 41 and 42. The resonant frequency f0 is able to be changed by changing the separation distance between the wall-surface conductors 41 and 42.

Figure 2:
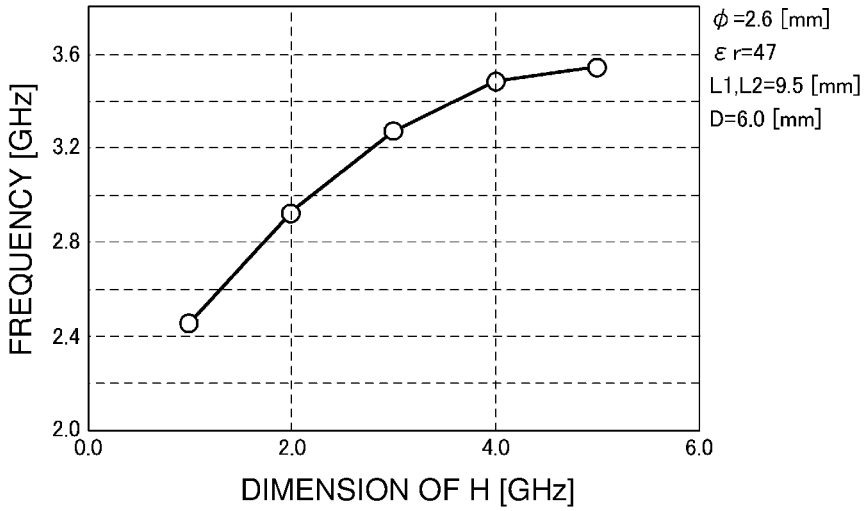
FIG. 2 is a graph that illustrates changes in the resonant frequency of the dielectric resonator according to the first preferred embodiment of the present invention.

FIG. 2 is a graph that illustrates changes in the resonant frequency of the dielectric resonator according to the first preferred embodiment of the present invention. FIG. 2 illustrates an example in which L1=L2=about 9.5 mm, D=about 5.0 mm, ϕ=about 2.6 mm, and $\varepsilon_r$=about 47. FIG. 2 illustrates the changes in the resonant frequency f0 with respect to the changes in the separation distance H between the wall-surface conductors 41 and 42.

As illustrated in FIG. 2, the resonant frequency f0 changes in accordance with the separation distance H. Specifically, the resonant frequency f0 increases with an increase in the separation distance H.

In the dielectric resonator 10 according to the present preferred embodiment, different values in the resonant frequency f0 are obtainable simply by changing the separation distance between the wall-surface conductors 41 and 42 around the through hole 21 without having to change the outer dimensions of the dielectric block 20, the material of the dielectric block 20, and the shape of the through hole 21. In other words, the resonant frequency f0 of the dielectric resonator 10 using TE-mode resonance is able to be adjusted without changing the outer dimensions.

The dielectric resonator 10 having the above-described configuration may be used in a dielectric filter, as described below.

Figure 3A:
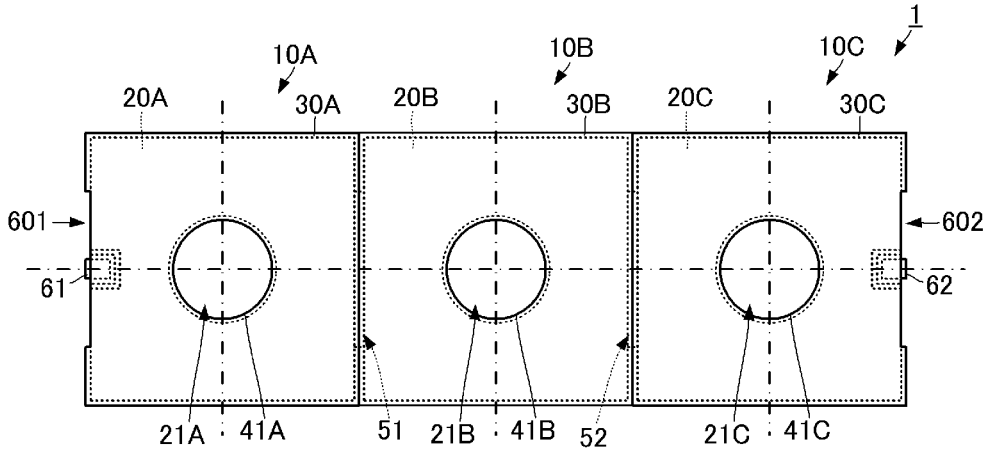
FIG. 3A is a plan view of a dielectric filter according to the first preferred embodiment of the present invention.
Figure 3B:
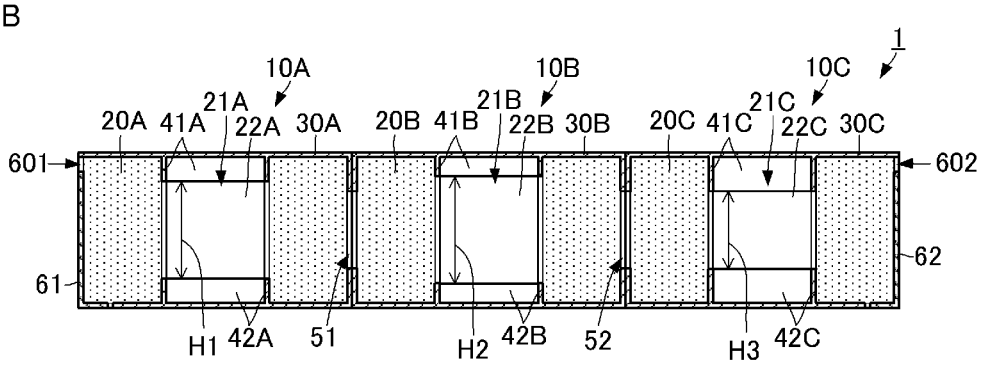
FIG. 3B is a side cross-sectional view of the dielectric filter according to the first preferred embodiment of the present invention.
Figure 4:
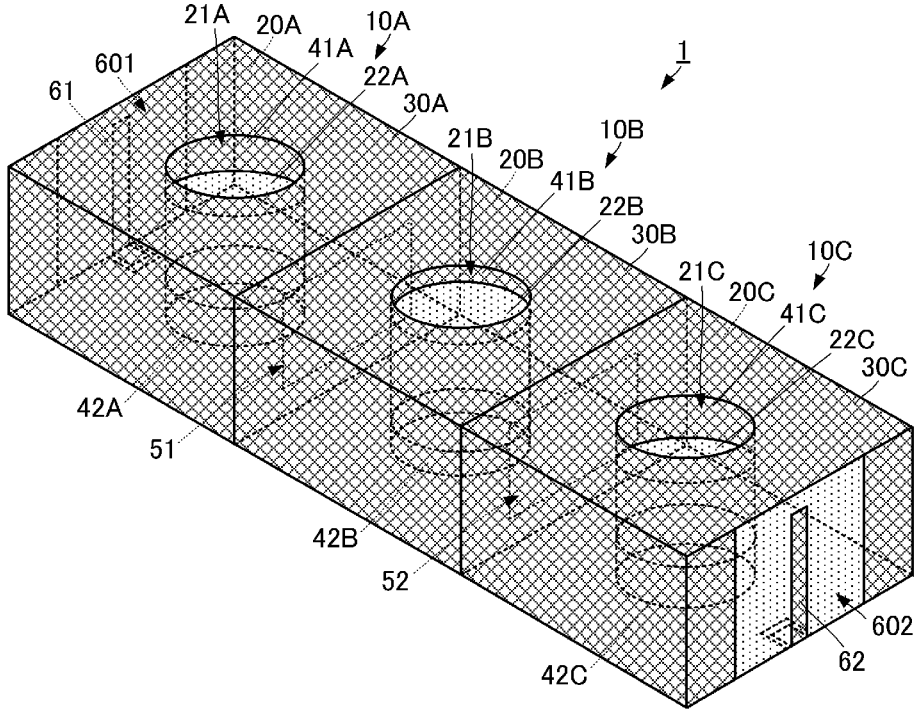
FIG. 4 is an external perspective view of the dielectric filter according to the first preferred embodiment of the present invention.

FIG. 3A is a plan view of a dielectric filter according to the first preferred embodiment of the present invention. FIG. 3B is a side cross-sectional view of the dielectric filter according to the first preferred embodiment of the present invention. FIG. 4 is an external perspective view of the dielectric filter according to the first preferred embodiment of the present invention.

As illustrated in FIGS. 3A and 3B, a dielectric filter 1 includes a plurality of dielectric resonators 10A, 10B, and 10C. Each of the plurality of dielectric resonators 10A, 10B, and 10C is the same or substantially the same as the dielectric resonator 10 according to the first preferred embodiment in terms of the fundamental structure and is different therefrom in terms of the separation distance. Each of the plurality of dielectric resonators 10A, 10B, and 10C corresponds to a "first dielectric resonator" or a "second dielectric resonator".

A separation distance H1 between a wall-surface conductor 41A and a wall-surface conductor 42A in the dielectric resonator 10A, a separation distance H2 between a wall-surface conductor 41B and a wall-surface conductor 42B in the dielectric resonator 10B, and a separation distance H3 between a wall-surface conductor 41C and a wall-surface conductor 42C in the dielectric resonator 10C are different from each other. Therefore, a resonant frequency f0A of the dielectric resonator 10A, a resonant frequency f0B of the dielectric resonator 10B, and a resonant frequency f0C of the dielectric resonator 10C are different from each other.

The dielectric resonators 10A and 10B are in contact with each other. The contact surface is a side surface perpendicular or substantially perpendicular to the first surface and the second surface in each of the dielectric resonators 10A and 10B. A coupling window 51 is provided in an external conductor 30A and an external conductor 30B at their contact surfaces. The coupling window 51 is a portion at which the external conductors 30A and 30B are not present. The coupling window 51 is preferably rectangular or substantially rectangular when the surface of each of the dielectric blocks 20A and 20B in which the coupling window 51 is provided is seen in plan view.

The dielectric resonators 10B and 10C are in contact with each other. The contact surface is a side surface perpendicular or substantially perpendicular to the first surface and the second surface in each of the dielectric resonators 10B and 10C. A coupling window 52 is provided in the external conductor 30B and an external conductor 30C at their contact surfaces. The coupling window 52 is a portion at which the external conductors 30B and 30C are not present. The coupling window 52 is preferably rectangular or substantially rectangular when the surface of each of the dielectric blocks 20B and 20C in which the coupling window 52 is provided is seen in plan view.

An external coupling conductor 61 is disposed on the surface opposed to the surface in which the coupling window 51 is provided of the dielectric resonator 10A. The external coupling conductor 61 is a strip conductor having a predetermined width. A portion of the external coupling conductor 61 extends to the second surface. The external coupling conductor 61 is separated from the external conductor 30A by a conductor absent portion 301.

An external coupling conductor 61 is disposed on the surface opposed to the surface in which the coupling window 51 is provided of the dielectric resonator 10A. The external coupling conductor 61 is a strip conductor having a predetermined width. A portion of the external coupling conductor 61 extends to the second surface of the dielectric block 20A. The external coupling conductor 61 is separated from the external conductor 30A by a conductor absent portion 601. Thus, in this configuration, the dielectric filter 1 includes a first external coupling terminal on the dielectric resonator 10A side.

An external coupling conductor 62 is disposed on the surface opposed to the surface of the dielectric resonator 10C in which the coupling window 52 is provided. The external coupling conductor 61 is a strip conductor having a predetermined width. A portion of the external coupling conductor 62 extends to the second surface of the dielectric block 20C. The external coupling conductor 62 is separated from the external conductor 30C by a conductor absent portion 602. Thus, in this configuration, the dielectric filter 1 includes a second external coupling terminal on the dielectric resonator 10C side.

In the above-described configuration, the filter characteristics of the dielectric filter 1 are set by the resonant frequencies of the plurality of dielectric resonators 10A, 10B, and 10C. Accordingly, because the resonant frequencies of the plurality of dielectric resonators 10A, 10B, and 10C are able to be individually adjusted, the filter characteristics of the dielectric filter 1 are able to be easily adjusted. Therefore, the dielectric filter 1 having desired filter characteristics is able to be easily obtained.

Even when the plurality of dielectric resonators 10A, 10B, and 10C have different resonant frequencies, they have the same outer shape. Accordingly, the plurality of dielectric resonators 10A, 10B, and 10C are able to be formed by the same process, except for the adjustment of the lengths of the separation distances H1, H2, and H3. Thus, the dielectric filter 1 with desired filter characteristics is able to be easily obtained.

Because the plurality of dielectric resonators 10A, 10B, and 10C operate in TE mode, in comparison with resonators operating in other mode, Q0 is able to be improved more easily, and filter characteristics of low loss in a pass band are able to be achieved more readily.

Figure 5:
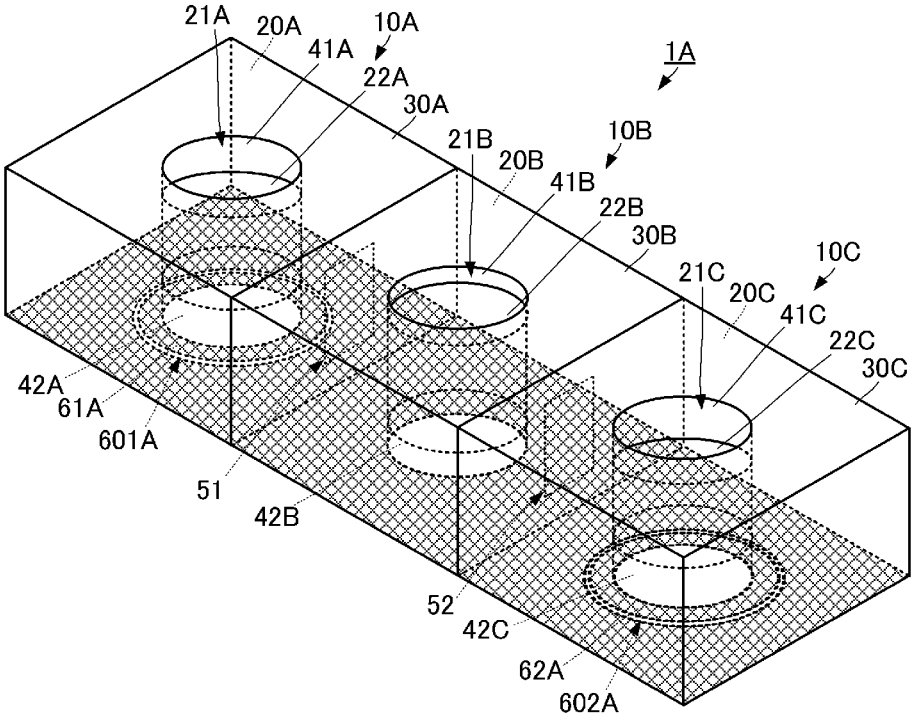
FIG. 5 is a perspective view that illustrates a configuration of a dielectric filter according to a second preferred embodiment of the present invention.

Next, a dielectric filter according to a second preferred embodiment of the present invention is described with reference to a drawing. FIG. 5 is a perspective view that illustrates a configuration of the dielectric filter according to the second preferred embodiment of the present invention. In FIG. 5, to facilitate understanding of the features, only the second surface portion of each of the dielectric resonators is hatched.

A dielectric filter 1A according to the present preferred embodiment differs from the dielectric filter 1 according to the first preferred embodiment in the positions and shapes of the external coupling terminals. The remaining configuration of the dielectric filter 1A is the same or substantially the same as that of the dielectric filter 1 according to the first preferred embodiment, and the same features are not described.

An external coupling conductor 61A is disposed on the second surface (surface including one opening of a through hole 21A) of the dielectric block 20A in the dielectric resonator 10A. The external coupling conductor 61A is concentric with the opening of the through hole 21A and is connected to the wall-surface conductor 42A. The external coupling conductor 61A is separated from the external conductor 30A by a conductor absent portion 601A.

An external coupling conductor 62A is disposed on the second surface (surface including one opening of a through hole 21C) of the dielectric block 20C in the dielectric resonator 10C. The external coupling conductor 62A is concentric with the opening of the through hole 21C and is connected to the wall-surface conductor 42C. The external coupling conductor 62A is separated from the external conductor 30A by a conductor absent portion 602A.

With the above-described configuration, the dielectric filter 1A is able to provide the same or substantially the same operational advantages as those of the dielectric filter 1 according to the first preferred embodiment.

Figure 6:
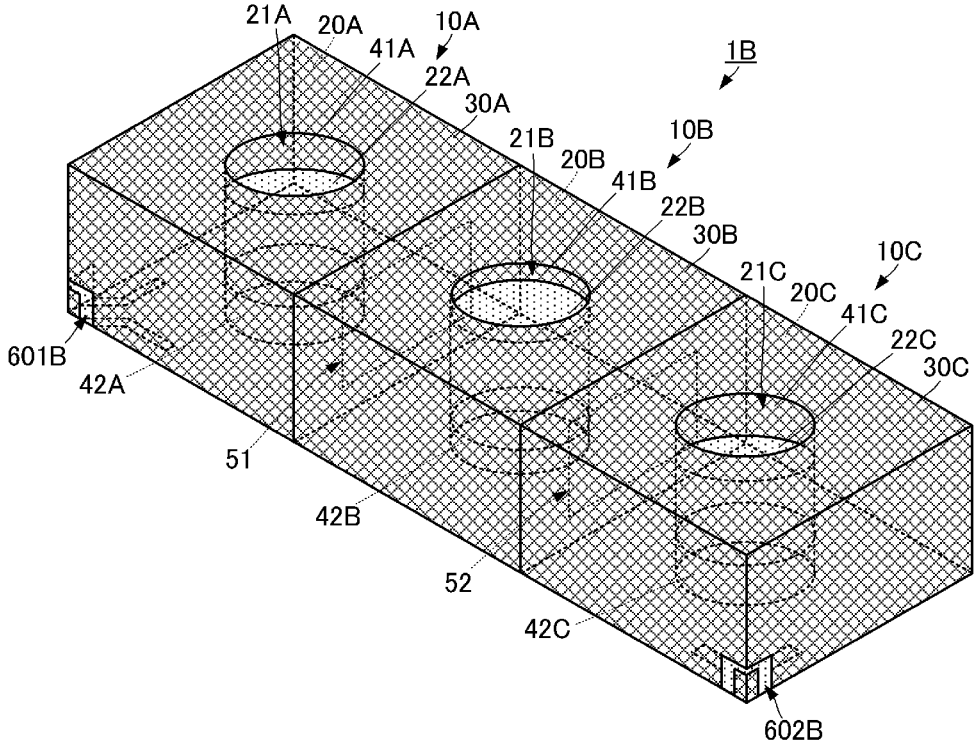
FIG. 6 is a perspective view that illustrates a configuration of a dielectric filter according to a third preferred embodiment of the present invention.

Next, a dielectric filter according to a third preferred embodiment of the present invention is described with reference to a drawing. FIG. 6 is a perspective view that illustrates a configuration of the dielectric filter according to the third preferred embodiment of the present invention.

A dielectric filter 1B according to the present preferred embodiment differs from the dielectric filter 1 according to the first preferred embodiment in the positions and shapes of the external coupling terminals. The remaining configuration of the dielectric filter 1A is the same or substantially the same as that of the dielectric filter 1 according to the first preferred embodiment, and the same features are not described.

A conductor absent portion 601B having a Y shape is disposed on a corner portion of the dielectric resonator 10A on the side opposite to the side in contact with the dielectric resonator 10B. Thus, the external coupling terminal on the dielectric resonator 10A side is disposed in the dielectric filter 1B.

A conductor absent portion 602B having a Y shape is disposed on a corner portion of the dielectric resonator 10C on the side opposite to the side in contact with the dielectric resonator 10B. Thus, the external coupling terminal on the dielectric resonator 10C side is disposed in the dielectric filter 1B.

With the above-described configuration, the dielectric filter 1B is able to provide the same or substantially the same operational advantages as those of the dielectric filter 1 according to the first preferred embodiment.

Figure 7:
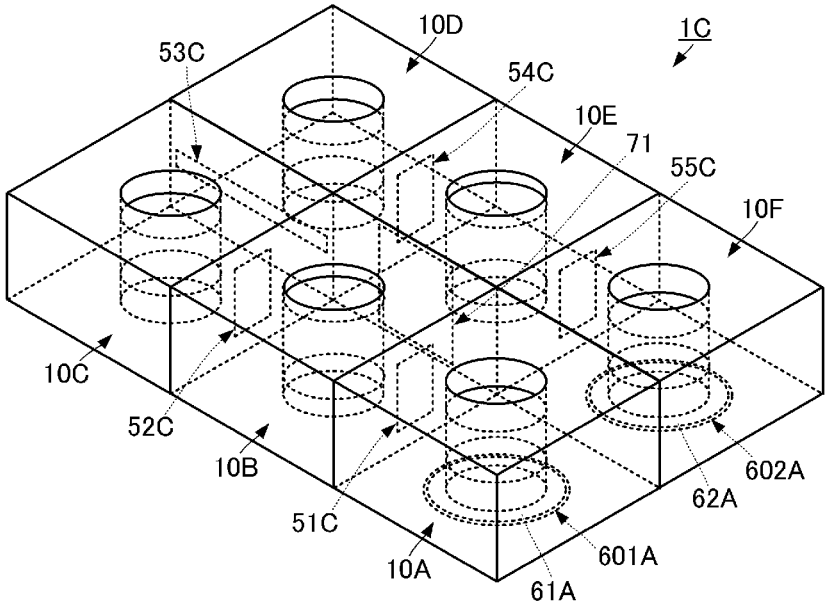
FIG. 7 is a perspective view that illustrates a configuration of a dielectric filter according to a fourth preferred embodiment of the present invention.

Next, a dielectric filter according to a fourth preferred embodiment of the present invention is described with reference to a drawing. FIG. 7 is a perspective view that illustrates a configuration of the dielectric filter according to the fourth preferred embodiment of the present invention.

A dielectric filter 1C according to the present preferred embodiment differs from the dielectric filter 1A according to the second preferred embodiment in the number of dielectric resonators that are coupled and in the coupling configuration. The fundamental configuration of each of a plurality of dielectric resonators 10A, 10B, 10C, 10D, 10E, and 10F defining the dielectric filter 1C is the same or substantially the same as that of the dielectric resonator 10 according to the first preferred embodiment.

In the plurality of dielectric resonators 10A, 10B, 10C, 10D, 10E, and 10F, as illustrated in the above-described preferred embodiments, the distance between two wall-surface conductors at opposite ends of the through hole is individually adjusted.

The dielectric resonators 10A, 10B, and 10C are aligned in this order. The dielectric resonators 10D, 10E, and 10F are aligned in this order. The dielectric resonators 10A and 10F are aligned in a direction perpendicular or substantially perpendicular to the direction in which the dielectric resonators 10A, 10B, and 10C are aligned. The dielectric resonators 10B and 10E are aligned in the direction perpendicular or substantially perpendicular to the direction in which the dielectric resonators 10A, 10B, and 10C are aligned. The dielectric resonators 10C and 10D are aligned in the direction perpendicular or substantially perpendicular to the direction in which the dielectric resonators 10A, 10B, and 10C are aligned.

The dielectric resonator 10A is in contact with the dielectric resonators 10B and 10F. The dielectric resonator 10B is in contact with the dielectric resonators 10A, 10C, and 10E. The dielectric resonator 10C is in contact with the dielectric resonators 10B and 10D. The dielectric resonator 10D is in contact with the dielectric resonators 10C and 10E. The dielectric resonator 10E is in contact with the dielectric resonators 10B, 10D, and 10F. The dielectric resonator 10F is in contact with the dielectric resonators 10A and 10E.

The dielectric resonators 10A and 10B are coupled by a coupling window 51C. The dielectric resonators 10B and 10C are coupled by a coupling window 52C. The dielectric resonators 10C and 10D are coupled by a coupling window 53C. The dielectric resonators 10D and 10E are coupled by a coupling window 54C. The dielectric resonators 10E and 10F are coupled by a coupling window 55C. The dielectric resonators 10B and 10E are coupled by a coupling window 71 that provides jump coupling.

With this configuration, the dielectric filter 1C includes not only a path connected from the dielectric resonator 10B through the dielectric resonators 10C and 10D to the dielectric resonator 10E but also a path connected from the dielectric resonator 10B directly to the dielectric resonator 10E by the coupling window 71 that provides jump coupling. Thus, the dielectric filter 1C is able to achieve more various filter characteristics, in comparison to a configuration without the coupling window 71 that provides jump coupling.

The present preferred embodiment illustrates a mode in which the dielectric resonator 10B defining a first dielectric resonator and the dielectric resonator 10E defining a second dielectric resonator are coupled without being coupled through two dielectric resonators. A mode in which the first dielectric resonator and second dielectric resonator are coupled without being coupled through at least one dielectric resonator may also be used.

Figure 8:
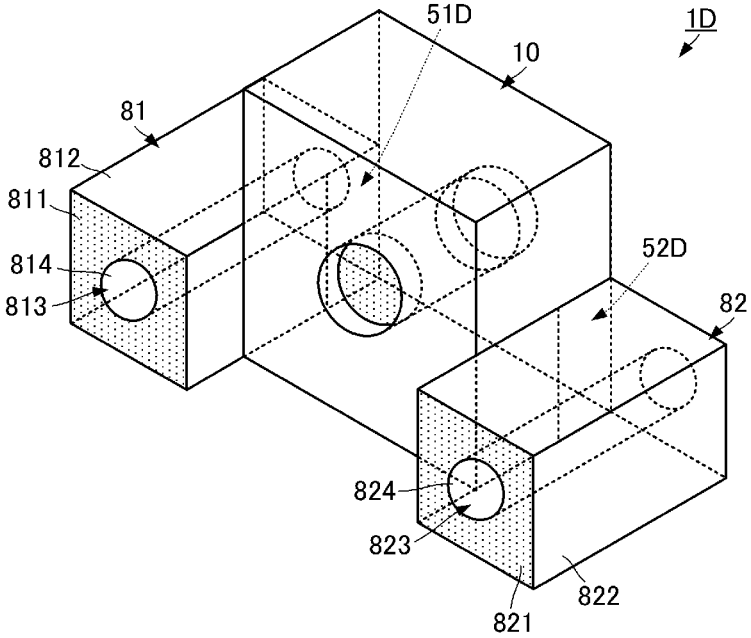
FIG. 8 is a perspective view that illustrates a configuration of a dielectric filter according to a fifth preferred embodiment of the present invention.

Next, a dielectric filter according to a fifth preferred embodiment of the present invention is described with reference to drawings. FIG. 8 is an external perspective view of the dielectric filter according to the fifth preferred embodiment of the present invention.

A dielectric filter 1D according to the present preferred embodiment includes the dielectric resonator 10, which is configured to produce TE-mode resonance, and a plurality of dielectric resonators 81 and 82 that produce TEM-mode resonance.

The dielectric resonator 10 is the same or substantially the same as the dielectric resonator 10 according to the first preferred embodiment and thus is not described herein.

The dielectric resonator 81 includes a dielectric block 811 and an outer conductor 812. The dielectric block 811 preferably has a rectangular or substantially rectangular parallelepiped shape, for example. The dielectric block 811 includes a through hole 813. An inner conductor 814 is disposed on a wall surface defining the through hole 813. The outer conductor 812 is disposed on the entire or substantially the entire surface of the dielectric block 811, except for the surfaces in which the through hole 813 is opened. With this configuration, the dielectric resonator 81 produces TEM-mode resonance corresponding to its shape and relative permittivity.

The dielectric resonator 82 includes a dielectric block 821 and an outer conductor 822. The dielectric block 821 preferably has a rectangular or substantially rectangular parallelepiped shape, for example. The dielectric block 821 includes a through hole 823. An inner conductor 824 is disposed on a wall surface defining the through hole 823. The outer conductor 822 is disposed on the entire or substantially the entire surface of the dielectric block 821, except for the surfaces in which the through hole 823 is opened. With this configuration, the dielectric resonator 82 produces TEM-mode resonance corresponding to its shape and relative permittivity.

The dielectric resonator 81 and dielectric resonator 10 are in contact with each other at surfaces different from the surfaces in which their respective through holes are opened. These contact surfaces include a coupling window 51D. The coupling window 51D is defined by a conductor absent portion of the outer conductor 812 in the dielectric resonator 81 and that of the external conductor 30 in the dielectric resonator 10.

The dielectric resonator 82 and dielectric resonator 10 are in contact with each other at surfaces different from the surfaces in which their respective through holes are opened. These contact surfaces include a coupling window 52D. The coupling window 52D is defined by a conductor absent portion of the outer conductor 822 in the dielectric resonator 82 and that of the external conductor 30 in the dielectric resonator 10.

As described above, the dielectric filter 1D has the configuration in which the dielectric resonator 10 for TE-mode resonance and the dielectric resonators 81 and 82 for TEM-mode resonance are coupled.

Figure 9:
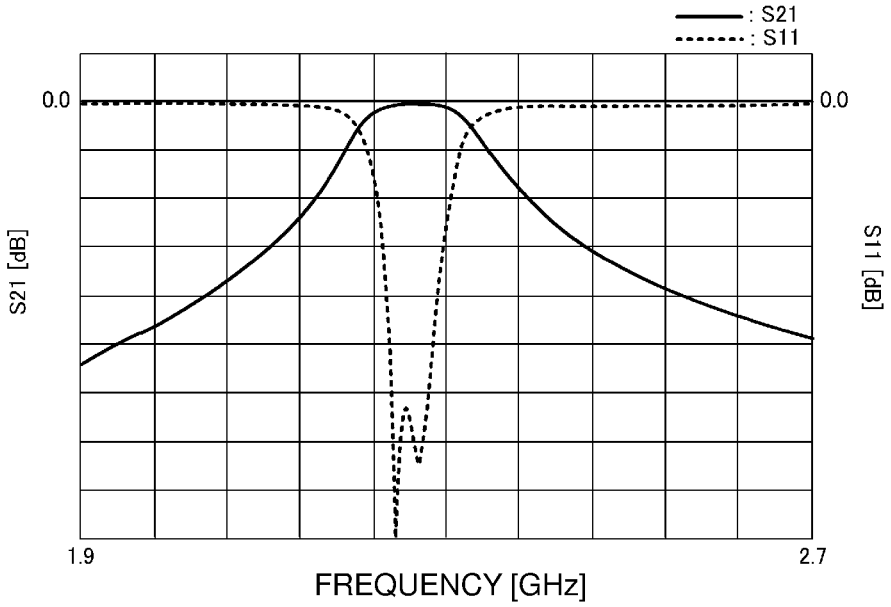
FIG. 9 illustrates S11 characteristics and S21 characteristics of the dielectric filter according to the fifth preferred embodiment of the present invention.

FIG. 9 illustrates S11 characteristics and S21 characteristics of the dielectric filter according to the fifth preferred embodiment of the present invention. As illustrated in FIG. 9, because of the combination of the dielectric resonator 10 for TE-mode resonance and the dielectric resonators 81 and 82 for TEM-mode resonance, the dielectric filter 1D is able to achieve transmission with low loss in a pass band and is able to achieve large attenuation in an attenuation range. Specifically, reduction in attenuation in a harmonic range, for example, is able to be reduced or prevented.

By appropriately adjusting the separation distance H in the dielectric resonator 10, the filter characteristics illustrated in FIG. 9 are able to be reliably and accurately achieved. In addition, the filter characteristics are able to be even more easily adjusted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A dielectric filter comprising:

at least two dielectric resonators, each including:

a dielectric block having a rectangular or substantially rectangular parallelepiped shape that includes a first surface and a second surface opposed to each other and a through hole that extends from the first surface to the second surface;

an external conductor disposed on an outer surface of the dielectric block; and a wall-surface conductor disposed on a wall surface defining the through hole; wherein the wall-surface conductor includes a first portion including an end portion of the through hole adjacent to and extending from the first surface and a second portion including an end portion of the through hole adjacent to and extending from the second surface;

the first portion and the second portion are electrically isolated from each other; and no conductor is provided between the first portion of the wall-surface conductor and the second portion of the wall-surface conductor;

a resonant frequency of each of the at least two dielectric resonators is adjusted by adjustment of a separation distance between the first portion of the wall-surface conductor and the second portion of the wall-surface conductor;

the at least two dielectric resonators are in contact with each other at a contact surface;

the contact surface is a side surface different from the first and second surfaces in which the respective through holes are opened; and a portion at which conductors are not present is provided at the contact surface.

2. The dielectric filter according to claim 1, wherein the dielectric block of each of the at least two dielectric resonators is made of a dielectric ceramic material.

3. The dielectric filter according to claim 1, wherein the dielectric block of each of the at least two dielectric resonators has a relative permittivity in a range of about 40 to about 50.

4. The dielectric filter according to claim 1, wherein the through hole of each of the at least two dielectric resonators is circular or substantially circular.

5. The dielectric filter according to claim 1, wherein in each of the at least two dielectric resonators, an axis in an extending direction of the through hole is perpendicular or substantially perpendicular to the first surface and the second surface.

6. The dielectric filter according to claim 1, wherein the at least two dielectric resonators define a first dielectric resonator and a second dielectric resonator that are coupled to each other; and a separation distance between the first portion and the second portion in the first dielectric resonator and a separation distance between the first portion and the second portion in the second dielectric resonator are different from each other.

7. The dielectric filter according to claim 1, wherein the at least two dielectric resonators define a plurality of dielectric resonators that are coupled to each other; and the plurality of dielectric resonators have mutually different separation distances between the first portions and second portions.

* * * * *